US005154486A

United States Patent [19]

Gehry

[11] Patent Number: 5,154,486

[45] Date of Patent: Oct. 13, 1992

[54] FURNITURE COMPRISING LAMINATED SLATS AND METHODS OF MANUFACTURING SUCH FURNITURE

[75] Inventor: Frank O. Gehry, Santa Monica, Calif.

[73] Assignee: Westinghouse Electric Corp., Pittsburgh, Pa.

[21] Appl. No.: 588,115

[22] Filed: Sep. 24, 1990

[51] Int. Cl.[5] ..... A47C 5/14

[52] U.S. Cl. ..... 297/445; 297/446

[58] Field of Search ..... 297/445, 446; 428/175, 428/179, 182, 184, 106; D6/369, 370

[56] References Cited

U.S. PATENT DOCUMENTS

| | | | |
|---|---|---|---|
| D. 12,144 | 2/1881 | Bent . | |
| D. 151,967 | 12/1948 | Cunningham | D15/1 |
| D. 249,836 | 10/1978 | Olko | D6/57 |
| D. 266,545 | 10/1982 | Caldwell | D6/1 |
| D. 267,135 | 12/1982 | Claman | D6/369 X |
| D. 296,628 | 7/1988 | Glass | D6/380 |
| 1,385,387 | 7/1921 | Morandi | 144/349 |
| 1,548,026 | 8/1925 | Hansen . | |
| 1,778,250 | 10/1930 | Elmendorf | 144/2 R |
| 2,373,738 | 4/1945 | Atwood | 428/106 |
| 2,640,517 | 6/1953 | de Mello | 144/283 |
| 2,640,527 | 6/1953 | Kreizelman | 155/193 |
| 2,692,007 | 10/1954 | Christian | 297/446 X |
| 4,210,182 | 7/1980 | Danko | 144/317 |
| 4,495,019 | 1/1985 | Ogg | 156/222 |

FOREIGN PATENT DOCUMENTS

| | | |
|---|---|---|
| 278237 | 10/1951 | Fed. Rep. of Germany . |
| 361122 | 5/1906 | France . |
| 14271 | 10/1911 | France . |
| 853697 | 3/1940 | France . |
| 1398052 | 3/1965 | France . |

*Primary Examiner*—Kenneth J. Dorner
*Assistant Examiner*—Milton Nelson, Jr.
*Attorney, Agent, or Firm*—B. R. Studebaker

[57] ABSTRACT

Furniture comprises a strong, aesthetically appealing, woven lattice of interlocking slats. The slats are made of wood laminate having indentations allowing fitting of the slats across one another so as to form the lattice. Advantageously, the furniture may be manufactured of a single type of material, that of the bent wood laminate slats. No other supporting structural material is needed to make the furniture simultaneously possess the advantages of being sturdy, aesthetically appealing, economical to manufacture, and light in structure and appearance. The methods of manufacturing such furniture has also been included.

20 Claims, 5 Drawing Sheets

FURNITURE COMPRISING LAMINATED SLATS AND METHODS OF MANUFACTURING SUCH FURNITURE

BACKGROUND OF THE INVENTION

1. Field of the Invention

The present invention relates to furniture such as chairs which are made up of interwoven slats, and methods for manufacturing such furniture. More specifically, the invention relates to furniture and manufacturing methods in which slats are arranged in an interlocking lattice structure.

2. Related Art

It has been and remains a goal of fine furniture manufacturers to provide furniture that is simultaneously aesthetically pleasing, ergonomically comfortable, physically sturdy, and economical to manufacture.

One way to keep manufacturing costs down, is to make furniture from a minimum number of parts. By minimizing the number and types of parts, it becomes easier to assemble a chair into a finished product. This results in simplification and streamlining of the manufacturing process.

For aesthetic appeal, it is often thought desirable to provide furniture which is not "boxy" or "clumsy" in appearance. The furniture should project an appearance of lightness and stylishness. Sometimes the goals of physical lightness and economy of manufacture are in conflict. For example, if the surface of a chair were manufactured of a web of light-weight material, the weight-bearing frame of the chair has ordinarily been of different, heavier elements such as thick wooden or metal rods. See, for example, U.S. Pat. No. 151,967 and U.S. Pat. No. 12,144. In such known furniture, simplicity of manufacture has been compromised for the benefit of sturdiness.

In order to accomplish the aesthetic goal, lightweight material is advantageously employed. Lightness may be accomplished by using material which is thin, to avoid giving the furniture a bulky or boxy appearance. Unfortunately, using thin material which also satisfies the goal of structural strength has traditionally required use of metals, which in turn has prevented the furniture from being economical to manufacture.

Wood, because of its appearance and ease of working, is a common material for furniture. Further, wood has the advantage of thermal insulation, which, in practice, means that it does not feel uncomfortably cold in winter and painfully hot in summer. For ergonomic comfort, flexible and shaped materials are used to allow the furniture to flex and fit the shape of the body of the user. Traditional wood furniture with its thickness and hardness has not often fulfilled these criteria.

However, in certain cases, furniture which has been constructed of wood has been thicker than desirable, in order to meet demands of structural strength. See, for example, U.S. Pat. No. 12,144. Further, furniture made of wood often requires a large number of different parts, such as when thick wooden structural elements support thinner elements, such as the visible faces of the furniture.

Therefore, there is a need to provide furniture, and a method of manufacturing the same, in which the furniture is manufactured of a small number of different types of parts, thereby simplifying construction. There is a also need to provide furniture, and a method of manufacturing the same, in which the furniture is sturdy. There is further a need to provide furniture, and a method of manufacturing the same, in which the furniture is aesthetically pleasing. There is a further need to provide furniture which is ergonomically sound and comfortable. The present invention is directed toward filling those needs.

SUMMARY OF THE INVENTION

Furniture according to the present invention comprises a strong, aesthetically appealing, ergonomically comfortable, woven lattice of interlocking slats. In a preferred embodiment, the slats are made of a wood laminate having indentations allowing fitting of the slats across one another so as to form the flat surfaced lattice. Advantageously, furniture according to the present invention may be manufactured of a single type of material, such as bent wood laminate slats. No other support structural material is needed to make the furniture simultaneously possess the advantages of being sturdy, aesthetically appealing, and economical to manufacture. Similarly, the use of independent and connected slats allow different parts of the chair to flex and bend to ergonomically conform to the end user's body.

The invention also provides methods of manufacturing such furniture. For example, in a preferred method, strips of material to be laminated are placed on a primary form in layers with an adhesive substance spread between adjacent strips. A caul strip is placed over the stack of strips. A sheet of rigid material is then placed over the caul strip. A secondary form and blocks are placed over the sheet of rigid material after which pressure is applied to the blocks and secondary form. After the adhesive substance dries, the blocks, secondary form, sheet of rigid material, and caul are removed. Then the laminated slats are lifted from the primary form. A plurality of slats made by this process are then woven into a piece of furniture. Another method employing sheets or shells of laminated material that are subsequently cut into slats is also contemplated.

Thus, it is a primary object of the present invention to provide furniture, and methods of making furniture, in which the furniture is sturdy, aesthetically pleasing, ergonomically fit and economical to manufacture.

It is a further object of the invention to provide furniture, and methods of making furniture, in which the furniture is manufactured of a small number of different parts, such as slats of a light but strong material such as wood laminate.

These and other objects and advantages will become apparent when the specification is read taking into account the drawings.

BRIEF DESCRIPTION OF THE DRAWINGS

The invention is better understood by reading the following DETAILED DESCRIPTION OF THE PREFERRED EMBODIMENTS with reference to the accompanying drawing figures, in which like reference numerals refer to like elements throughout, and in which.

DETAILED DESCRIPTION OF THE PREFERRED EMBODIMENTS

Figure 1:
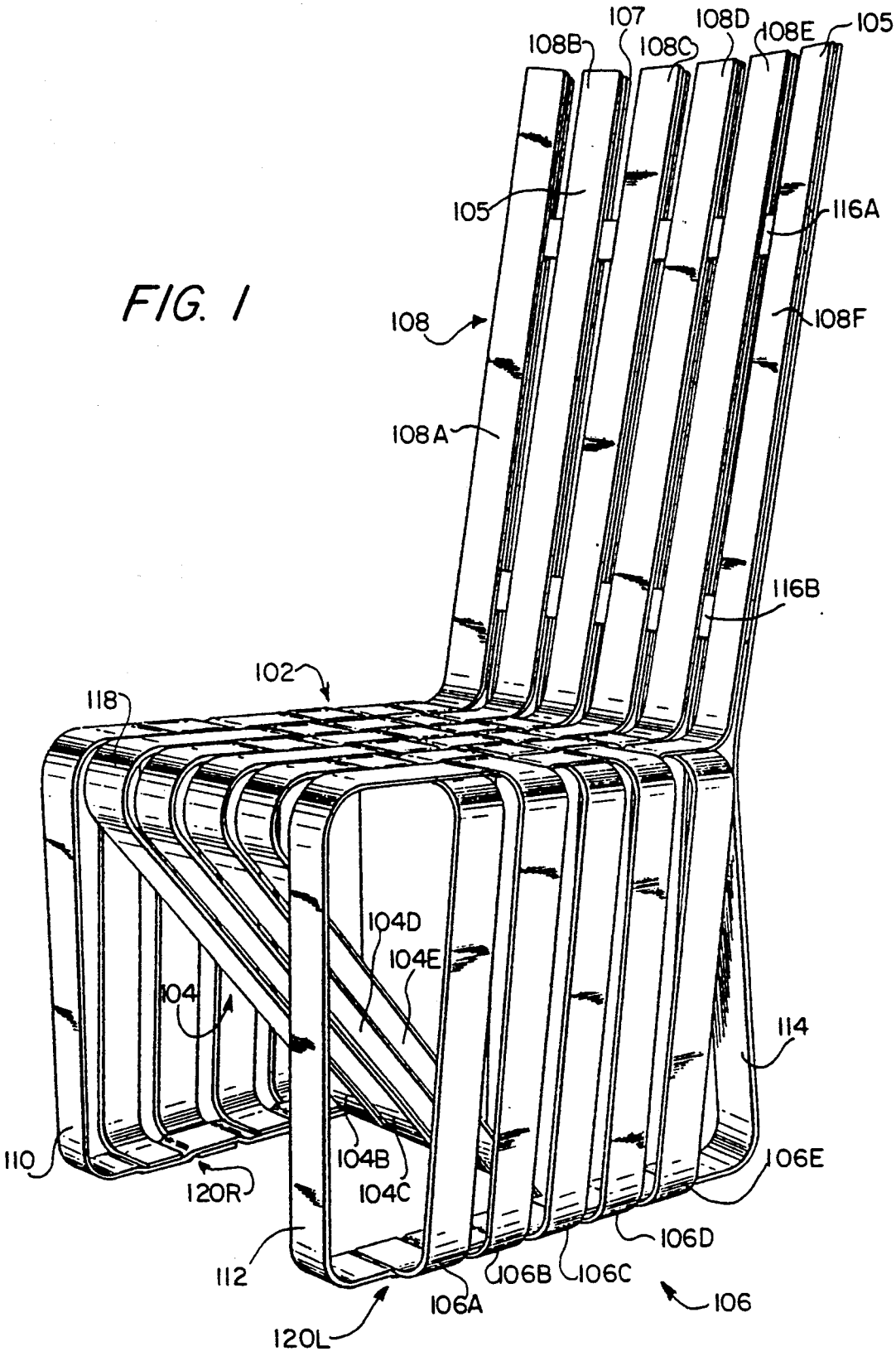
FIG. 1 illustrates in perspective view a chair according to a first embodiment of the invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

In contrast to known furniture, preferred embodiments of the present invention comprise a lattice of interlocking slats of wood laminate. The slats have indentations allowing the slats to fit across one another securely in an interlocking arrangement, thus forming furniture of structural soundness. Wood provides a material that is light in weight, easy to finish, and low in cost. The same may be said with regard to aluminum.

According to the present invention, the wood laminate slats alone may form both the supporting structure and the visible surfaces of the furniture. This is in contrast to known furniture of comparable weight, in which either thicker, heavier slats are employed (such as in U.S. Pat. Nos. 296,628 and 266,545); or a support structure of thicker beams supports a surfacing of a lighter material supported between the beams (such as in U.S. Pat. Nos. 151,967 and 12,144).

Figure 2:
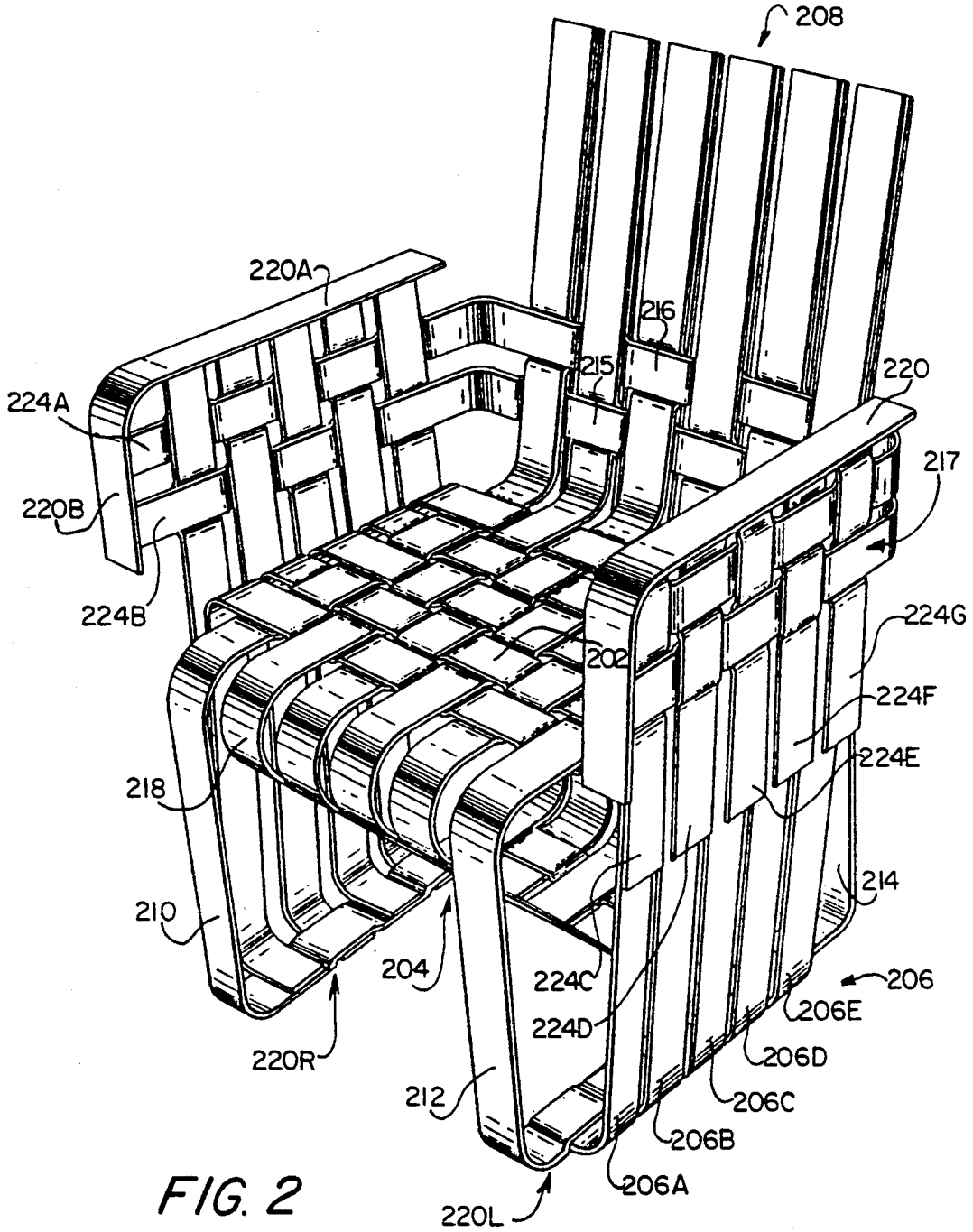
FIG. 2 illustrates in perspective view a chair according to a second embodiment of the invention.
Figure 3:
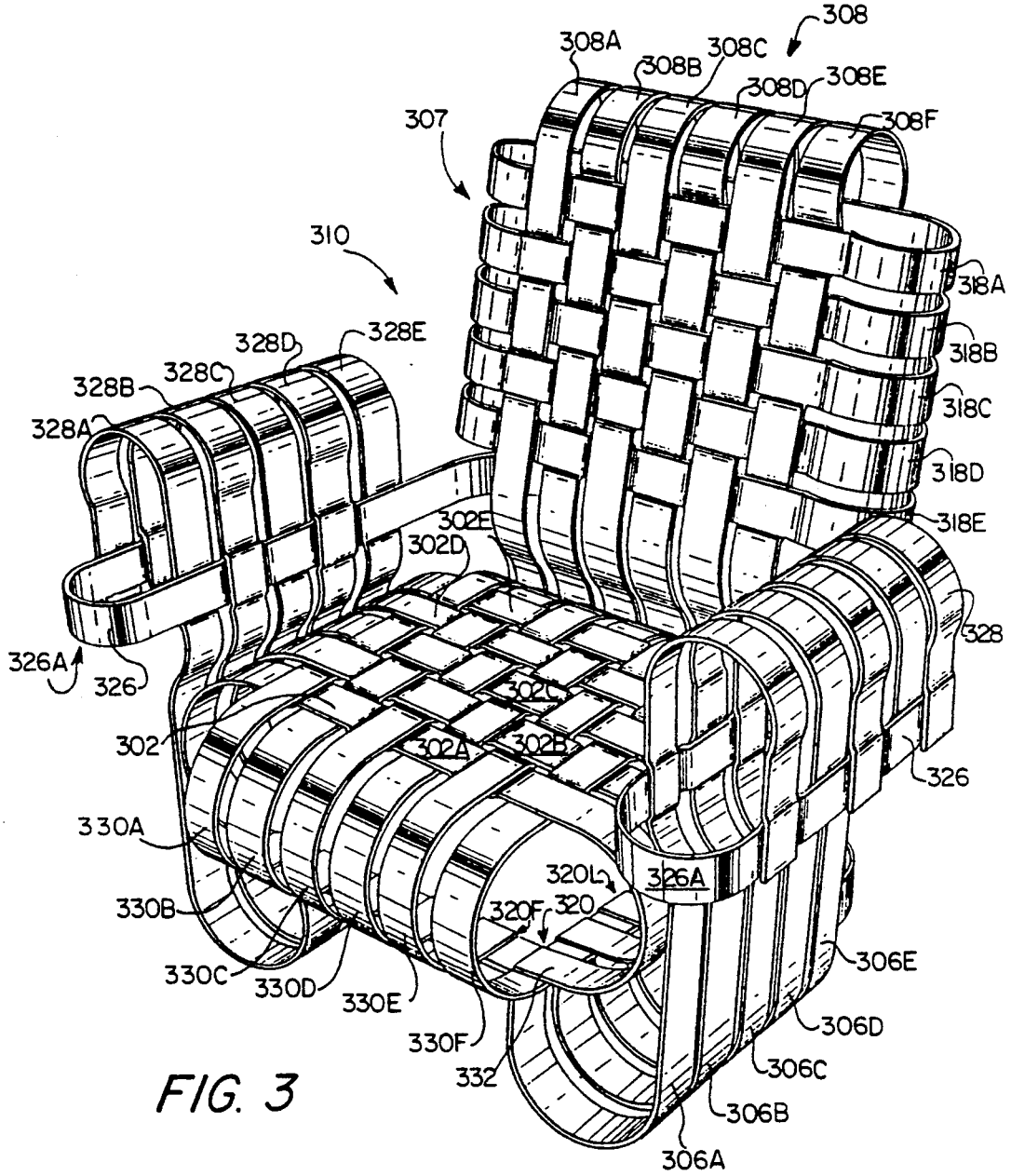
FIG. 3 illustrates in perspective view a chair according to a third embodiment of the invention.

FIGS. 1, 2 and 3 illustrate exemplary embodiments of chairs according to the present invention.

Figure 1A:
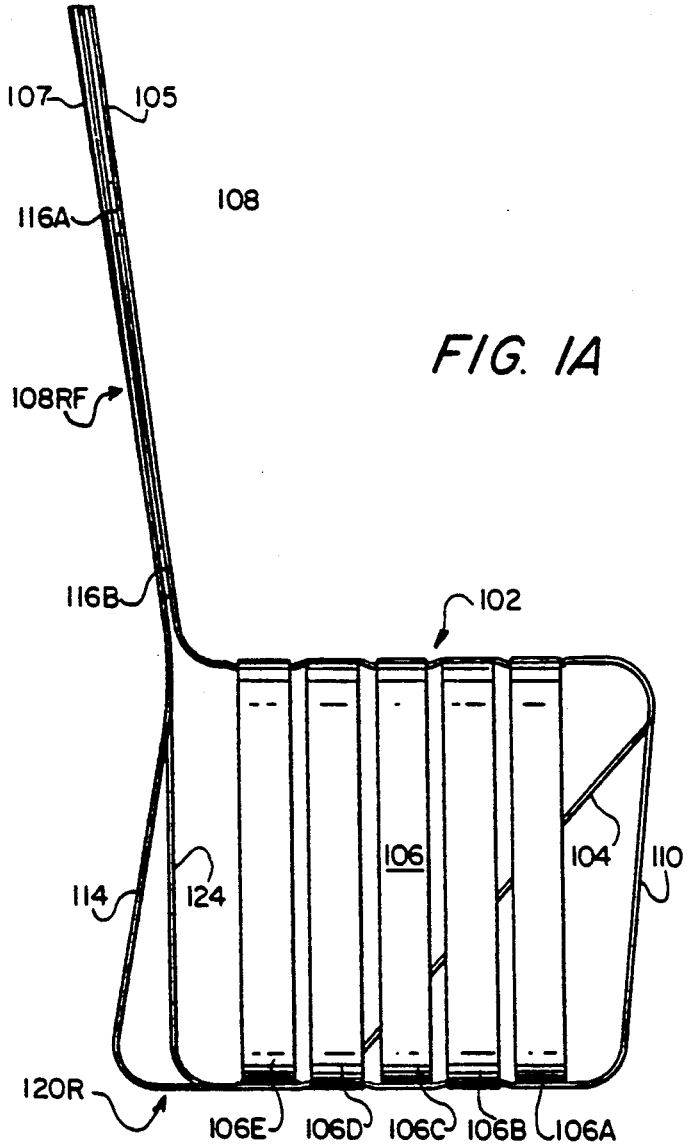
FIG. 1A is a side view of the embodiment of a chair illustrated in FIG. 1.

FIGS. 1 and 1A illustrate a chair comprising seat 102, left and right side portions 106, front portion 104 flanked by front edge slats 110 and 112, and chair back 108.

Seat 102 is a planar utilization area made up of an interlocking lattice of six longitudinal slats and five lateral (or transverse) slats, the lattice manufactured according to the present invention. Support for the seat is provided by left and right side portions 106, front edge slats 110 and 112, front portion 104, and rear portion 124.

The back portion 108 has six pairs of parallel slats, each pair comprising a frontwardly facing back slat 105 and a rearwardly facing back slat 107. Only frontwardly facing back slats 108A through 108F are specifically numbered in FIG. 1, but it is understood that the slats 108A through 108F are paired with rearwardly facing back slats 107 collectively illustrated in FIG. 1A as 108RF.

Side portion 106 comprises five vertically oriented slats 106A through 106E which are continuous extensions of the slats which comprise the five lateral slats of the seat 102. They first extend downwardly, then curving inwardly to meet the ground, providing support for the seat portion.

Front portion 104 comprises four slats 104B through 104E which are continuous extensions of the four center longitudinal slats that are part of seat portion 102 Slats 104B through 104E extend downward from the seat portion 102 at an angle of approximately 45° with respect to the horizontal seat 102. Slats 104B through 104E extend downward to reach the ground, thus providing further support to the seat portion. Slats 104B through 104E continue along the ground horizontally for approximately ¼ the distance of the longitudinal depth of the seat portion 102, and are interwoven with slat 106E which extends the entire transverse width of the chair. After being interwoven with slat 106E, the slats 104B through 104E curve upward in a substantially vertical rear portion 124, shown most clearly in FIG. 1A. Rear portion 124 extends from the ground to back portion 108, forming the rear middle four slats 107 thereof.

Front edge slats 110 and 112 are continuous extensions of the two outermost longitudinal slats of seat 102. Front edge slats extend downwardly at an angle of approximately 82° with respect to the horizontal seat portion, extending to run rearwardly along the ground in a woven relationship with slats 106A through 106E for a distance slightly less than the longitudinal depth of the seat portion 102. The two opposite segments of the edge slats which run along the ground are illustrated in FIG. 1 as base portions 120L and 120R. The base slats 120L and 120R have consecutive alternate indentations for receiving the ends of side slats 106A through 106D and the continuation of slat 106E, thus securing the bottom of the side portion to an extension of the edge of the front portion. Curving upwardly from the rear end of base portions 120L and 120R are rear edge slats 114 which in turn continuously extend upwardly to comprise two of the rearwardly facing outermost back slats 107 of back portion 108.

As shown in FIG. 1A, the two rear edge slats 114 project rearwardly from the bases 120L and 120R (FIG. 1) by a different amount than do the four inner slats of rear portion 124. The more localized front portion 104 and rear portion 124 enable greater central support for the individual sitting on the center of the chair. The edge slats comprising front edge slats 110, 112, bases 120L and 120R, and rear edge slats 114 are further from the center of the chair so as to provide a broader base of support, which is important for the stability of the chair. As these structures extend further from the center of gravity of the chair, the individual may shift his or her weight forward, backward, or laterally with a reduced possibility of the chair tipping over.

As already mentioned, back portion 108 has six parallel paired slats 108A through 108F. One slat 105 of the pair extending continuously upward from the longitudinal slats of seat portion 102, and the second slat 107 of the pair (collectively indicated by reference numeral 108RF) projecting continuously upward from rear edge slats 114 and back portion 124.

In this manner, the six slats comprising frontwardly facing back slats 108A through 108F; the longitudinal slats of seat portion 102; the front edge slats 110 and 112 and the front portion slats 104B through 104E and the portions of the slats running along the ground; rear portion slats 124 and rear edge slats 114; and rearwardly facing back slats 108RF comprise a set of six continuous slats, curved so as to interlock with the five transverse slats 106A through 106E to form the chair described above.

In the embodiment of FIG. 1, the two outermost slats 110 and 112 are nearly identical, differing only in their complementary indentations for receiving lateral slats 106A through 106E. The inner four longitudinal slats 104B through 104E are nearly identical; the second (104B) and fourth (104D), and the third (104C) and fifth slats (104E), are identical Similarly, side slats 106A and 106C may be identical, as may side slats 106B and 106D, because they all traverse a path from the ground upward, then laterally through the seat 102, downward along the opposite side portion, and terminating in the other longitudinal edge slat on the ground. In this arrangement, therefore, the number of types of components is minimized, thus simplifying manufacturing and reducing manufacturing cost. Transverse slat 106E is continuous laterally through base portions 120L and 120R, as well as front slats 104B through 104E.

In the embodiment shown in FIGS. 1 and IA, cross-supports 116A and 116B are employed as horizontal braces to the vertical slats of back portion 108. The cross-supports are affixed between corresponding pairs of frontwardly facing back slats 108A through 108F, and rearwardly facing back slats 108RF. Cross-support 116A is disposed approximately 80% of the way from the seat portion 102 to the top edge of back slats 108A through 108F. Cross-support 116B, which may be identical in construction to cross-support 116A, is disposed approximately 15% of the way from the seat portion to the top edge of back slats 108A through 108F. Cross-supports 116A and 116B are flat segments of wood laminate, not possessing any indentations. Cross-supports 116A and 116B maintain the back slats 108A through 108F in alignment by being glued at cross-points to back slats 108A through 108F and 108RF. Cross-support 116A is a bent lamination conforming to a segment of a 36" radius arc, whereas cross-support 116B is a straight member. Insertion of cross-support 116A at the upper part of the chair back introduces a concave reformation of the back slats 108A through 108F from a flat plane at the base of the chair back formed by cross-support 116B to that of a curved arc. This adds physical comfort and security to the user.

In the chair illustrated in FIGS. 1 and IA, therefore, only four distinct components are needed to construct an entire chair; specifically, two longitudinal edge slats, four inner longitudinal slats, five transverse slats, and two cross-supports. In this manner, the number of components and the number of types of components are reduced.

FIG. 2 illustrates a second embodiment of a chair fabricated in accordance with the present invention. Most components of the FIG. 2 chair correspond to those in the FIG. 1 embodiment, such as seat portion 202, side portions 206, front edge slats 210 and 212, rear edge slats 214, back portion 208, and receding front portion 204.

Additionally, however, arm rest 220 and arm rest support 224 are provided. Arm rest 220 is a slat of laminated wood having a single bend between a longer, horizontal portion 220A and a shorter vertical portion 220B extending from the front end of the horizontal portion. Arm rest support 22 comprises a lattice of interlocking slats of the same type as seat portion 202. In the illustrated embodiment, the lattice comprises two horizontal slats 224A and 224B which extend continuously from one arm rest from portion 220B to the other while being interwoven with back portion 208. The FIG. 2 embodiment thus replaces the straight cross-supports 116 of Figure with an interlocking-slat lattice structure 215 including slats 216. Slats 216 advantageously comprise continuations of horizontal slats from arm rest supports 224 so as to provide additional structural cohesion between the back and sides of the chair.

Each arm rest 224 has five vertical slats 224C through 224G which overlap with the two horizontal slats 224A and 224B to form an interlocking lattice structure 217. The top ends of the vertical slats 224C through 224G bend inwardly and horizontally to be affixed to the underside of correspond arm rest 220. The bottom ends of the five vertical slats are affixed as by an adhesive to the outer surfaces of the five corresponding slats 206A through 206E of side portion 206.

The two horizontal slats such as slat 216 occupy only approximately the bottom one-third of the back portion 208, so that only one-third of the back portion is a lattice. The upper two-thirds of the back portion are six pairs of parallel slats which project upwardly as continuations of the longitudinal slats which project from the lattice in the lower one-third. No cross-supports are present, as they are in the FIG. 1 embodiment. In the FIG. 2 configuration, the upper two-thirds of the chair is allowed to more fully conform to the back of an individual who sits in the chair.

Advantageously, the total number of types of parts in the chair is kept small by repeated use of identically-shaped, or nearly identically-shaped slats of wood. In addition to the slats which are repeated in the same manner of the FIG. 1 embodiment, the arm rests are identical, and the horizontal and vertical slats which comprise the arm rest supports are nearly identical, varying only in their alternation of indentations for securing the lattice structure.

Figure 5:
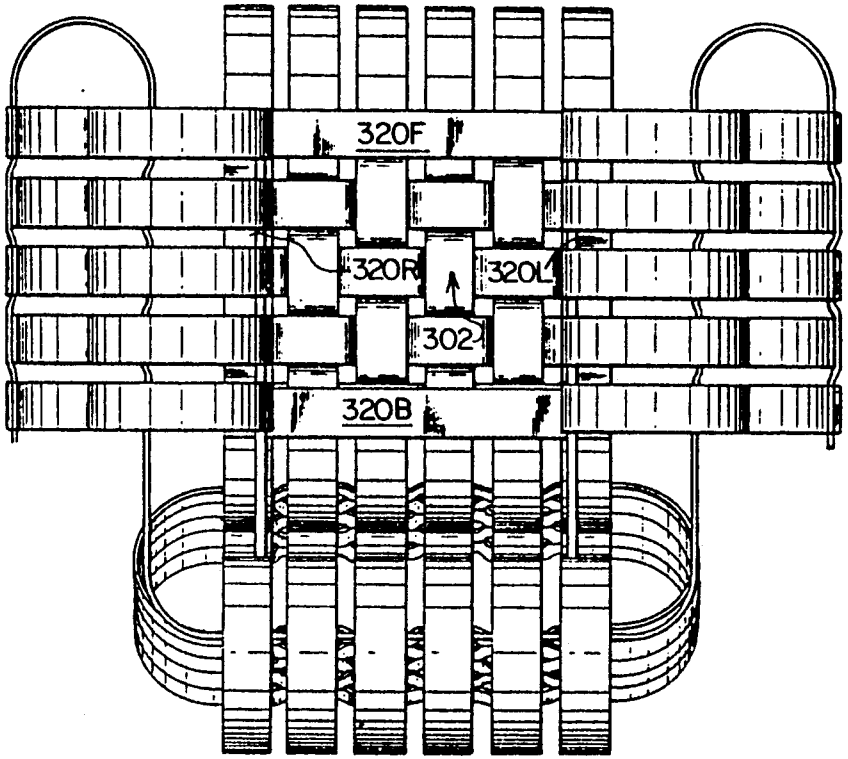
FIG. 5 is a bottom plan view of the chair of FIG. 3.
Figure 4:
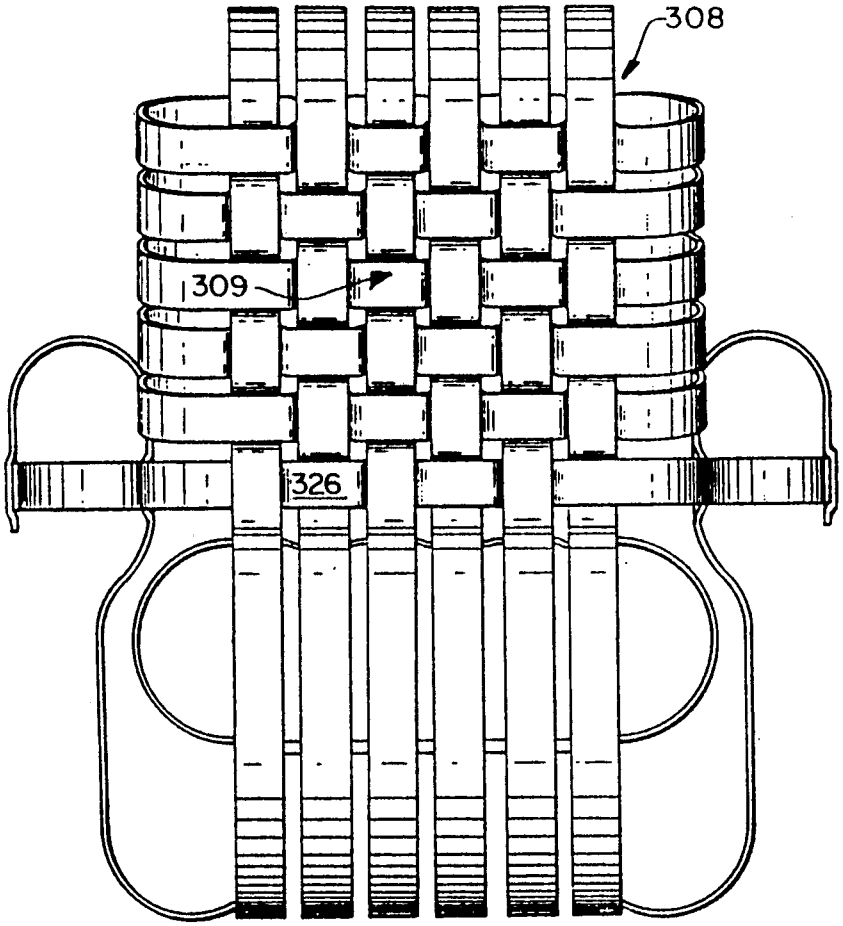
FIG. 4 is a rear plan view of the chair of FIG. 3.

FIGS. 3 through 5 illustrate a third embodiment of a chair 310 fabricated in accordance with the present invention. The third embodiment further illustrates application of the interlocking slat structure of the invention.

Both seat portion 302 and back portion 308 comprise lattices of interlocking slats. Unlike the embodiments of FIGS. 1 and 2, the FIG. 3 embodiment provides that the five transverse slats, and the six frontwardly projecting longitudinal slats curve downwardly and then inwardly in a 180° arc. At the ends of their respective arcs, the slats are joined by a slat running transverse to them.

Specifically, on the underside of chair 310 there is a support brace 320 made up of four flat slats 320F, 320L, 320R and 320B that are arranged in a square. The longitudinal slats 330A through 330F terminate in an alternating arrangement and are glued to the upper surface of slat 320F as viewed in FIG. 3 and to slat 320B. Similarly, the leftmost portions of slats 302A through 302E are glued to slat 320L. The rightmost part of slats 302A through 302E are glued to slat 320R.

Arm rest portions 328 comprise five vertically oriented slats 328A through 328E which first extend upward, and then curve back downward, to interlock at two points with a horizontal slat 326 which curves back around on itself in an analogous fashion. Thereafter, the five arm rest slats continue downward to comprise the five vertically oriented slats 306A through 306E of side portion 306. Finally, the vertically oriented slats 306A through 306E curve gently inward and upward in a 180° arc, and are secured to the underside of slats 320L and 320R. At the bottom of the arc, 90° into the 180° arc, the chair touches the ground.

Horizontal slat 326 extends from the rear outside portion of one arm rest forward to the front of the arm rest, curving inward and backward in a 180° arc 326A, then extending rearwardly to join in an interlocking fashion the vertical slats of the arm rest along both its forward and rearward extensions. Thereafter, slat 326 curves inwardly 90° to traverse the back portion 308 in an interlocking arrangement with the slats in the rear part 309 of chair back 308. On the opposite side of the back portion, slat 326 traverses a path which is a mirror image of its path on the first arm rest. In this manner, slat 326 joins and provides mutual structural stability to the back portion, arm rests and side portions.

Front portions 104 and 204 (from FIGS. 1 and 2) have been replaced with an interlocking support structure in which longitudinal seat portion slats 330A through 330F curve 180° to interlock with the slats making up support structure 320. Slats from side portion 306 curve upward from the ground to support the interlocking areas of the seat portion's longitudinal and lateral slats 330 and 332.

In this arrangement, a substantial cushioning effect is achieved. As the individual sits on the seat portion 302 of the chair, the curved arcs of the longitudinal and transverse slats which are extensions of the seat portion's lattice are bent slightly by the weight of the individual. Similarly, the weight causes the bottom arc of side portion slats 306A through 306E to bent, cushioning shock which would otherwise be transmitted from the ground through the side portions.

In back portion 308, the top ends of the six longitudinal slats 308A through 308F, and both ends of the five transverse slats 318A through 318E of the back portion curve rearwardly and then inwardly in 180° arcs so as to form a woven lattice 309 that matches the woven lattice 307 defined on the chair back 308. Such a back portion structure provides a shock absorbing and cushioning effect as the individual leans back against the back portion of the chair.

Figure 6A:
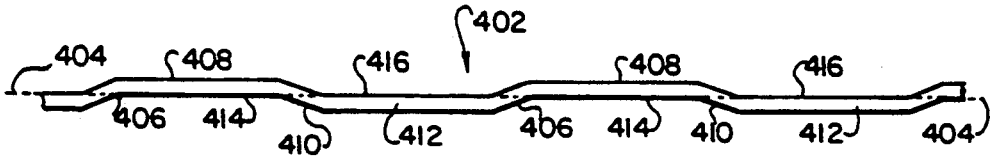
FIGS. 6A and 6B illustrate a profile of the preferred wood laminate, shown with indentations allowing strips of laminate to be fitted across one another at angles to form the web structure illustrated in the exemplary chairs shown in FIGS. 1, 2 and 3.

FIG. 6A illustrates in side view a short section of a wood laminate slat (generally illustrated as element 402) which may comprise the basic building element of the interlocking slat lattice according to the present invention. The slat comprises two major faces which are bent in the following manner.

A central imaginary plane 404 (perpendicular to the plane of the drawing figure) defines the location of alternating contact surfaces 414, 416, 414, 416 . . . . These alternating contact surfaces 414 and 416 are faces of corresponding parallel segments 408 and 412 which are located on opposite sides of the central plane 404. Consecutive parallel segments 408 and 412 are joined by connecting segments 406 and 410 which pass through the central plane 404 at an angle so as to join consecutive parallel segments.

Figure 6B:
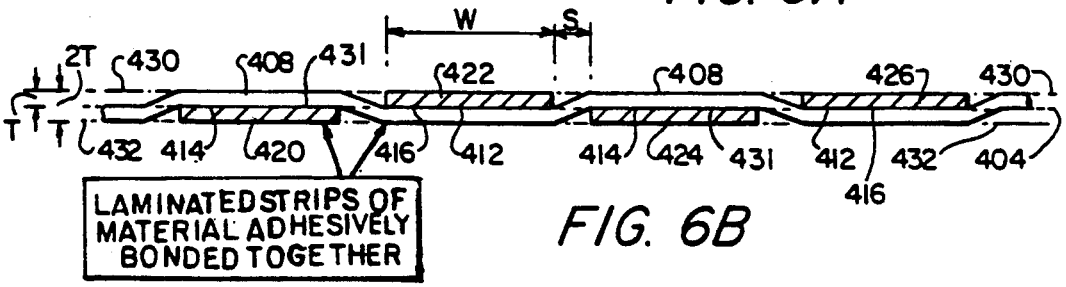

FIG. 6B illustrates the manner in which slats overlap and interlock so as to form the lattice structure which provides the aesthetic and structural advantages of furniture according to the present invention. FIG. 6B illustrates the slat 402 of FIG. 6A in conjunction with perpendicular slat 420, 422, 424 and 426 (shown in cross section, as they are perpendicular to the plane of the drawing figure). The perpendicular slats contact the original slat 402 at contact surfaces 414 and 416.

Because the thickness of slats 420, 422, 424 and 426 is substantially the same as slat 402, and because the perpendicular slats intersect the original in the central plane 400, two surface planes 430 and 432 are defined by the outer surfaces of the interlocking slats.

The choice of slats having substantially identical thickness allows a smooth surface to be presented to the user of the furniture. That is, when considering a surface of the furniture which is large compared to the slats, a substantially smooth surface is experienced. This implies that, when a person sits in the chair, he or she does not experience an irregular surface which may cause discomfort.

Advantageously, the angles of interconnecting segments 406 and 410 on the main slat (FIG. 6A) prevent adjacent parallel slats 420 through 426 from shifting laterally on slat 402. The intersecting slats are preferably affixed to one another using adhesive at the contact surfaces so as to enhance the structural strength provided by their interlocking configuration. By securely affixing the perpendicular slats, any stress placed upon one slat is passed on more efficiently to adjacent slats, in both the longitudinal and lateral directions, so that the overall configuration is capable of withstanding increased stresses from weight bearing.

In a preferred embodiment, the slats shown in FIG. 6B may be fabricated thin in width W (such as 2") with narrow spaces S between adjacent parallel slats (such as 0.75"), so that an individual sitting on or feeling the furniture is presented with a substantially smooth and continuous planar surface 430 or 432. Individual slat thickness T of 3/16" allows a total lattice thickness 2T of only ⅜", rendering the furniture light in weight and appearance. Of course, the slats may be of dimensions other than the specific dimensions provided here. Typical slat widths W may range from ½" to 5", with corresponding separation S of ⅜" to 1", and thickness T of ⅛" to ⅜".

More generally, slat thickness, width and separation should be chosen in light of considerations of strength, aesthetics and interlocking characteristics. For example, a widening of the separation may lighten the chair, but strength and the interlocking nature of the slats may be compromised as well as some of the ergonomic comfort. That is, a greater separation of longitudinal slats causes the interconnecting segments of transverse slats to be longer, and thus more oblique in angle. This obliqueness of angle reduces the interlocking strength of the lattice, so that the strength of the structure is more dependent on any adhesive which joins overlapping slats. The reduction in strength and interlocking nature may be compensated, for example, by increasing the thickness of the slats. Increasing the slat thickness increases the strength of the lattice both directly (by providing more load-bearing capability) as well as indirectly (by causing the interconnecting segments to be of a less oblique angle, thus enhancing the interlocking nature). Extra slat thickness may create a too flat and unyielding feel to the surface of the chair. Retaining a certain amount of flexibility to the overall surface of the chair is essential for physical comfort.

Exemplary pieces of furniture and the structure of the preferred interlocking lattice having been described above, the following is a disclosure of preferred methods of fabricating the furniture according to the present invention.

The invention provides a method of manufacturing a piece of furniture, comprising the steps which are described below.

In Step 1, strips of material to be laminated are placed on a primary form. Alternatively, sheets of material may be placed on a primary form, and later cut into strips for assembly into furniture. The primary form is advantageously comprised of a material, such as particle board, plywood, steel, epoxy resin or any other material which possesses the properties of ease of shaping with resistance to deformation from constant use and high pressures. The primary form is shaped to define with a secondary form a mold for shaping wood strips into a pre-formed slat. The face of the primary form thus has a series of parallel segments and non-parallel connecting segments which are the negative of the slat illustrated in side view in FIG. 6A.

During Step 2, an adhesive substance 431 is spread between adjacent strips to be laminated. This step may be performed before the set of strips or sheets is placed on the primary form. Adhesive substances which may be used include any permanent resin or glue, such as plastic resin or epoxy glue.

As part of Step 3, a caul strip is placed over the stack of strips to be laminated. The purpose of a caul strip is to distribute pressure evenly. The caul strip may advantageously comprise a material such as a piece of veneer wrapped in masking tape or neoprene rubber that is 1/16" to ¼" thick.

In Step 4, a sheet of rigid material is placed over the caul strip. The rigid material may be galvanized steel or other sheet metal, or any other material which will not deform under pressure.

For Step 5, blocks are placed over certain portions of the sheet of rigid material. The blocks may comprise wood or any other material such as aluminum or steel having the advantageous properties of ease of machining while not deforming from use under pressure.

During Step 6, a secondary form is placed over other certain points of the sheet of rigid material. The secondary form may comprise particle board, or any other material such as plywood or steel which has the advantageous properties of ease of machining while not deforming from use under pressure. The secondary form should be used at points where weave indentations will occur and the blocks should be used where straight flat areas are desired.

In Step 7, pressure is applied to the blocks and secondary form. This may be accomplished using clamps or hydraulic pressure, as known to those skilled in the art.

During Step 8, the adhesive substance is allowed to adhere the strips securely together, thereby forming laminated strips. Normally, this step comprises waiting until the glue cures, or applying heat or pressure to activate glues which are heat- or pressure-activated.

In Step 9, the blocks, secondary form, sheet of rigid material and caul are removed. Then, in Step 10, the laminated strips are removed from the primary form. If the laminate is in sheet form, it may now be cut into slats of appropriate length and width. The laminated sheet or slats should be substantially in the form in which they are to be assembled into the finished product. Of course, appropriate finishing and sealing steps may be performed at this stage.

Finally, in Step 11, the laminated slats are woven into a piece of furniture. This may be accomplished by either leaving the interlocking features of the lattice to act alone, or in concert with glue, other fixative substances, or fastening devices at the contact point of slats which cross at, for example, perpendicular angles.

In the above-described method, the primary and secondary particle board forms comprise one or more linear segments in which opposing faces of the forms form in the laminated slats a series of indentations facilitating fitting of slats of laminate across one another at an angle so as to form an interlocking lattice of laminated strips.

Modifications and variations of the above-described embodiments of the present invention are possible, as appreciated by those skilled in the art in light of the above teachings. For example, the slats may be fabricated of varying thickness, width, separation, and angle of intersection. Also, different portions of any given piece of furniture may comprise the interlocking lattice provided by the invention, either alone or in combination with other structural and aesthetic elements of the furniture. Further, the process of placing the unlaminated sheets on the forms and assembly of accompanying pressing means may be performed in an order other than that described specifically above.

It is therefore to be understood that, within the scope of the appended claims and their equivalents, the invention may be practiced otherwise than a specifically described.

What is claimed is:

1. A chair having a seat, a back and support legs, said chair comprising:

a plurality of first elongated slats extending in a first direction and arranged next to each other, each of said first slats including alternating first indentations preformed prior to assembly and being arranged to define a portion of the chair seat; and a plurality of second elongated slats extending in a second direction and arranged next to each other, each of said second slats including alternating second indentations preformed prior to assembly and being arranged in a woven relationship with said first preformed indentations to define the remaining portion of the chair seat, each of said first and second slats contributing to collectively define said chair seat, said chair back and said support legs.

2. The chair of claim 1, further comprising securing means for securing said first and second slats together at said crossing points.

3. The chair of claim 1, further comprising securing means for securing said first and second slats together at said crossing points.

4. The chair of claim 1, wherein said first and second slats are made from wood.

5. The chair of claim 4, wherein said first and second slats are made of laminated layers.

6. A chair having a seat and a back, said chair comprising:

a plurality of first elongated slats extending in a first direction and arranged next to each other, each of said first slats including alternating first indentations preformed prior to assembly and being arranged to define a portion of the chair seat; and a plurality of second elongated slats extending in a second direction and arranged next to each other, each of said second slats including alternating second indentations preformed prior to assembly and being arranged in a woven relationship, said first indentations mating with said second indentations to define the remaining portion of the chair seat, said first and second directions being at angles to each other and said first and second indentations complementing each other at crossing points to define essentially flat upper and lower surfaces within the chair seat.

7. The chair of claim 6 further comprising base means for supporting said chair seat, said base means being defined by said first and second elongated slats.

8. The article of furniture of claim 6, further comprising securing means for securing said first and second slats together at said cross points.

9. The chair of claim 6, wherein said first and second directions are at right angles to each other.

10. The chair of claim 6, wherein said first and second slats are made from wood.

11. The chair of claim 10, wherein said first and second slats are made of laminated layers.

12. An article of furniture having a planar utilization area, the article comprising:

a plurality of first elongated slats extending in a first direction and arranged next to each other, each of said first slats including alternating first indentations preformed prior to assembly and being arranged to define a portion of said utilization area; and a plurality of second elongated slats extending in a second direction and arranged next to each other, each of said second slats including alternating second indentations preformed prior to assembly and being arranged in a woven relationship, said first preformed indentations mating with said second preformed indentations to define the remaining portion of said utilization area, said first and second directions being at angles to each other and said first and second preformed indentations complementing each other at crossing points to define essentially flat upper and lower surfaces within said utilization area.

13. The article of furniture of claim 12, further comprising base means for supporting said utilization area, said base means being defined by said first and second elongated slats.

14. The article of furniture of claim 12, wherein said first and second slats are made from wood.

15. The article of furniture of claim 14, wherein said first and second slats are made of laminated layers.

16. The chair of claim 12, wherein said first and second directions are at right angles to each other.

17. An article of furniture comprising:

surface area defined by a lattice of interlocking slats preformed prior to assembly, each of the slats including plural layers of laminated wood, the slats having two faces and a series of consecutive segments, the consecutive segments and connecting segments; and (a) the contact surface segments located adjacent an imaginary central plane, with consecutive contact surface segments being on opposite sides of the imaginary central plane so that consecutive contact surfaces are on opposite faces of the slats; and (b) the connecting segments traversing the imaginary central plane to join consecutive contact surface segments;

wherein the lattice comprises the slats overlapping and touching at respective contact surfaces and being interlocked into the lattice by the angle of the connecting segments.

18. The article of furniture of claim 17, wherein the overlapping slats of the lattice are affixed to one another at the contact surfaces at which said overlapping strips touch.

19. The article of furniture of claim 17, wherein the slats overlap at substantially right angles.

20. The article of furniture of claim 17, wherein the slats of laminated wood are of a common thickness, so that the lattice globally comprises two lattice surface planes which are substantially smooth, and equidistant from the imaginary central plane.

* * * * *